US011772855B2

(12) United States Patent
Irwin

(10) Patent No.: US 11,772,855 B2
(45) Date of Patent: Oct. 3, 2023

(54) LOCKING ASSEMBLY FOR RELEASABLY-LOCKING A LID TO A CONTAINER

(71) Applicant: KacePack Ltd., Sheung Wan (HK)

(72) Inventor: George Douglas Irwin, Sheung Wan (HK)

(73) Assignee: KACEPACK LTD., Quarry Bay (HK)

( * ) Notice: Subject to any disclaimer, the term of this patent is extended or adjusted under 35 U.S.C. 154(b) by 0 days.

(21) Appl. No.: 17/661,566

(22) Filed: May 2, 2022

(65) Prior Publication Data

US 2022/0258927 A1 Aug. 18, 2022

Related U.S. Application Data

(63) Continuation of application No. 17/263,877, filed as application No. PCT/CN2019/071708 on Jan. 15, 2019, now Pat. No. 11,345,520.

(30) Foreign Application Priority Data

Jul. 27, 2018 (HK) ..... 18109773.4

(51) Int. Cl.
*B65D 43/12* (2006.01)
*B65D 50/04* (2006.01)

(52) U.S. Cl.
CPC ..... *B65D 43/12* (2013.01); *B65D 50/046* (2013.01); *B65D 2215/02* (2013.01)

(58) Field of Classification Search
CPC ..... B65D 45/22; B65D 45/16; B65D 50/046; B65D 50/045; B65D 50/04; B65D 43/12;
(Continued)

(56) References Cited

U.S. PATENT DOCUMENTS 2,086,534 A 7/1937 Byrne
3,782,584 A 1/1974 Swenson et al.
(Continued)

FOREIGN PATENT DOCUMENTS

CN 2431234 Y 5/2001
CN 202022417 U 11/2011
(Continued)

OTHER PUBLICATIONS

Evaluation Report of Utility Model Patent completed Feb. 7, 2022 in Chinese Application No. CN201990001025.X (6 pages).
(Continued)

*Primary Examiner* — Robert J Hicks
(74) *Attorney, Agent, or Firm* — Bookoff McAndrews, PLLC

(57) ABSTRACT

A locking assembly for releasably-locking a lid to a container includes shaped portions disposed on the lid and container that are configured to allow slidable engagement of the lid relative to the container along a movement axis. A locking nub disposed on a wall of the container and a nub receiving portion disposed on the lid are engaged when the lid and container are slidably engaged together, which restricts sliding movement of the lid relative to the container along the movement axis The wall of the container is inwardly depressible to move the locking nub outwardly of the nub receiving portion, which allows slidable movement relative to the container along the movement axis.

20 Claims, 2 Drawing Sheets

(58) Field of Classification Search
CPC .... B65D 43/02; B65D 43/20; B65D 43/0204; B65D 43/0237
USPC ..... 220/200, 785, 784, 780, 812, 811, 810, 220/326, 324; 206/1.5
See application file for complete search history.

(56) References Cited

U.S. PATENT DOCUMENTS

| | | | |
|---|---|---|---|
| 3,888,350 | A | 6/1975 | Horvath |
| 4,113,098 | A | 9/1978 | Howard |
| 4,126,224 | A | 11/1978 | Laauwe et al. |
| 4,561,544 | A | 12/1985 | Reeve |
| 4,946,057 | A | 8/1990 | Connolly et al. |
| 5,080,222 | A | 1/1992 | McNary |
| 5,082,137 | A | 1/1992 | Weinstein |
| 6,491,211 | B1 | 12/2002 | Evans et al. |
| 7,140,511 | B2 | 11/2006 | Baker et al. |
| 7,275,642 | B2 | 10/2007 | Yuhara |
| 7,708,142 | B2 | 5/2010 | Ehrlund |
| 7,757,843 | B2 | 7/2010 | Katsis |
| 8,657,136 | B2 | 2/2014 | Adler et al. |
| 9,346,594 | B2 | 5/2016 | Pipes et al. |
| 9,924,834 | B2 | 3/2018 | Joffe |
| 9,938,042 | B1 | 4/2018 | Aryanpanah et al. |
| 9,981,788 | B2 | 5/2018 | Skinner |
| 2004/0055903 | A1 | 3/2004 | Nishimura |
| 2007/0164032 | A1 | 7/2007 | Cronin et al. |
| 2007/0284277 | A1 | 12/2007 | Gnepper |
| 2009/0152134 | A1 | 6/2009 | Katsis |
| 2010/0018883 | A1 | 1/2010 | Patel |
| 2010/0038278 | A1 | 2/2010 | Gattefosse et al. |
| 2016/0001937 | A1 | 1/2016 | Skinner |
| 2017/0036808 | A1 | 2/2017 | Everett |
| 2018/0305092 | A1 | 10/2018 | Lucas, Jr. |
| 2021/0253315 | A1 | 8/2021 | Fortuny Cuadra |

FOREIGN PATENT DOCUMENTS

| | | | |
|---|---|---|---|
| CN | 203318926 | U | 12/2013 |
| CN | 203450531 | U | 2/2014 |
| CN | 106005726 | A | 10/2016 |
| CN | 205931769 | U | 2/2017 |
| CN | 207060798 | U | 3/2018 |
| CN | 207450641 | U | 6/2018 |
| EP | 2799364 | A1 | 11/2014 |
| WO | 01/15998 | A1 | 3/2001 |
| WO | 2013/099874 | A1 | 7/2013 |

OTHER PUBLICATIONS

Feng, Chao, Authorized Officer, National Intellectual Property Administration, PRC, "International Search Report" in connection with related International Application No. PCT/CN2019/071708, dated Apr. 30, 2019, 4 pgs.

Feng, Chao, Authorized Officer, National Intellectual Property Administration, PRC, "Written Opinion of the International Searching Authority" in connection with related International Application No. PCT/CN2019/071708, dated Apr. 30, 2019, 3 pgs.

Chinese Office Action dated Jun. 28, 2022 in Chinese Application No. 201990001025.X (7 pages).

International Search Report dated Nov. 27, 2020 in International Application No. PCT/CN2020/113432 (4 pages).

LOCKING ASSEMBLY FOR RELEASABLY-LOCKING A LID TO A CONTAINER

CROSS-REFERENCE TO RELATED APPLICATION(S)

This patent application is a continuation of and claims the benefit of priority to U.S. application Ser. No. 17/263,877, filed Jan. 27, 2021, the U.S. national phase entry under 35 U.S.C. § 371 of International Application No. PCT/CN2019/071708, filed on Jan. 15, 2019, which claims the benefit of priority from Hong Kong Application No. 18109773.4, filed on Jul. 27, 2018, the entireties of each of which are incorporated herein by reference.

TECHNICAL FIELD

The present invention relates to a locking mechanisms for containers including for instance child-safe locks.

BACKGROUND OF THE INVENTION

Certain food products, cleaning agents, medications and the like that are commonly found in the home may be dangerous to young children. Such substances must be transported and stored in containers having "child-safe" locking mechanisms for locking the lid of the container and which are difficult for children to open by means of challenging their cognition, dexterity and/or strength. Currently, existing child-safe locking mechanisms tend to utilise variations on one of a few common designs, such as the "push and twist" style cap. Whilst oftentimes effective, the prevalent use of this style of cap lock has become so widely used that children, of even younger ages, have become accustomed to them thus limiting their potential long-term effectiveness.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a locking assembly for releasably-locking a lid to a container so that the lid covers an opening of the container, the locking assembly including: shaped portions disposed on the lid and container that are configured to allow slidable engagement of the lid relative to the container along a movement axis between a first configuration in which the lid covers the opening in to a second configuration in which the lid does not cover the opening; a locking nub disposed on a wall of the container; a nub receiving portion disposed on the lid; and wherein when the lid and container are slidably engaged together in the first configuration, the locking nub disposed on the container is received within the nub receiving portion disposed on the lid so as to restrict sliding movement of the lid relative to the container along the movement axis from the first configuration in to the second configuration, and, wherein the wall of the container is inwardly depressible so as to move the locking nub outwardly of the nub receiving portion whereby the lid is then able to be slidably moved relative to the container along the movement axis from the first configuration in to the second configuration.

Preferably, at least one of the shaped portions may form a pair of rails disposed along a rim of the container opening, and at least one of the shaped portions form rail engagement elements disposed on the lid that are configured for slidable engagement with the rails.

Preferably, the locking nubs may extend outwardly from opposing elongate sidewalls of the container along at least one axis that is transverse to the movement axis.

Preferably, the lid may include a main body configured for covering the opening of the container, and side portions extending perpendicularly from elongate side-edges of the main body.

Preferably, the side portions may each include a nub receiving portion for receiving one of the locking nubs when the lid is slidably engaged with the container in the first configuration.

Preferably, the nub receiving portion may include at least one of a slot, a recess and a rebate.

Preferably, the present invention may include a humidity control material disposed on the lid of the container.

Preferably, the container may be is formed from at least one of a tin, aluminium or polymeric material.

In another broad form, the present invention provides a locking assembly for releasably-locking a lid to a container so that the lid covers an opening of the container, the locking assembly including: shaped portions disposed on the lid and container that are configured to allow slidable engagement of the lid relative to the container along a movement axis between a first configuration in which the lid covers the opening in to a second configuration in which the lid does not cover the opening; a locking nub disposed on the lid; a nub receiving portion disposed on a wall of the container; and wherein when the lid and container are slidably engaged together in the first configuration, the locking nub disposed on the lid is received within the nub receiving portion disposed on the container so as to restrict sliding movement of the lid relative to the container along the movement axis from the first configuration in to the second configuration, and, wherein the wall of the container is inwardly depressible so that the locking nub is moved relatively outwardly of the nub receiving portion and whereby the lid is then able to be slidably moved relative to the container along the movement axis from the first configuration in to the second configuration.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Preferred embodiments of the present invention will now be described herein with reference to FIGS. 1 to 4. The embodiments comprise a container (10A, 10B, 10C) having a child-safe type locking mechanism for releasably locking a lid (20A) on to the container (10A, 10B, 10C) so that the lid (20A, 20B, 20C) covers an opening of the container (10A, 10B, 10C).

Figure 1A:
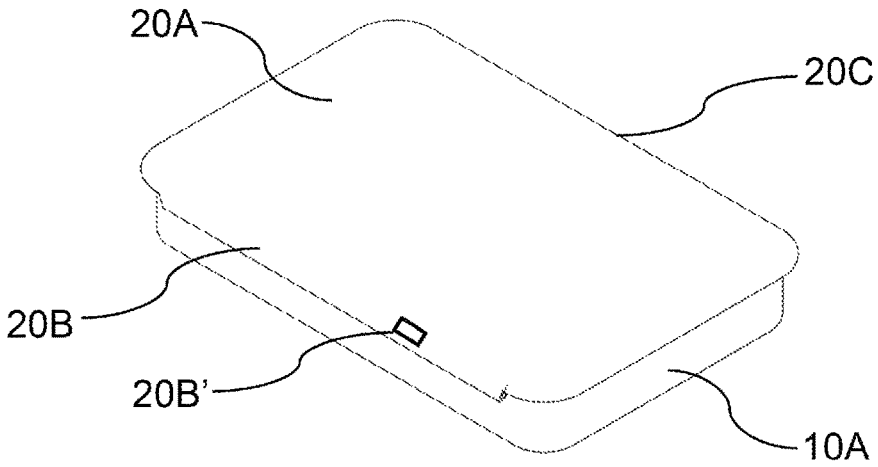
FIG. 1A shows a perspective view of a container having an opening covered by a lid in accordance with a first embodiment.
Figure 1B:
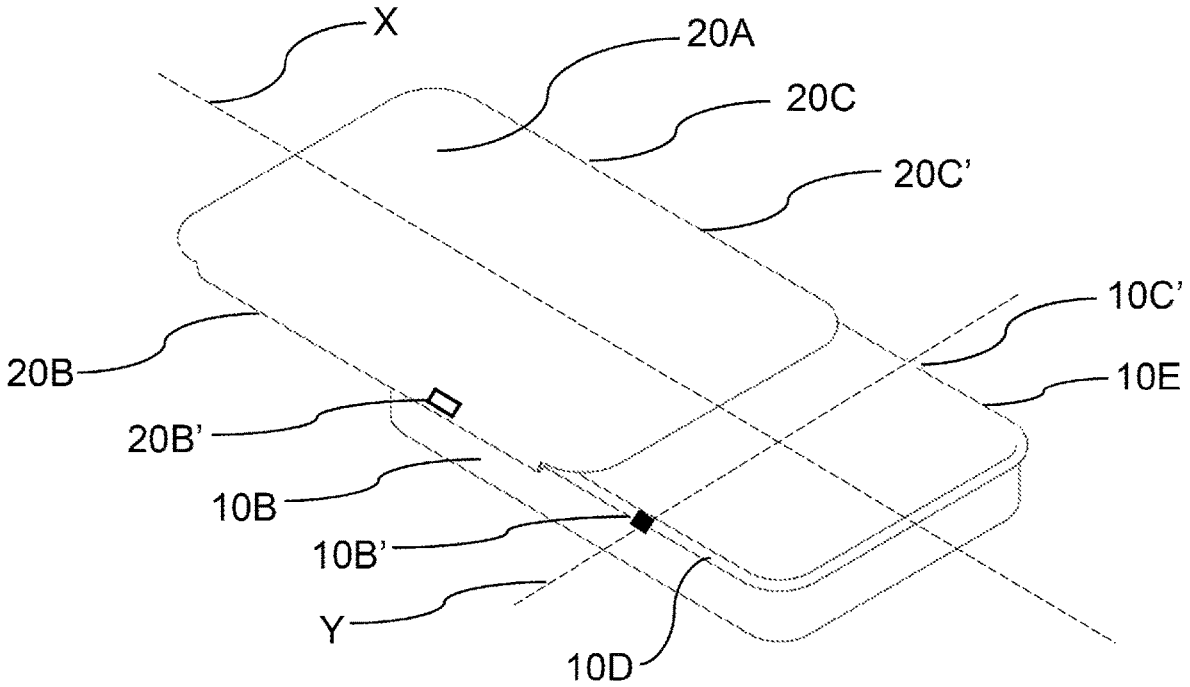
FIG. 1B shows a perspective view of the container having an opening partially covered by a lid in accordance with the first embodiment.
Figure 2:
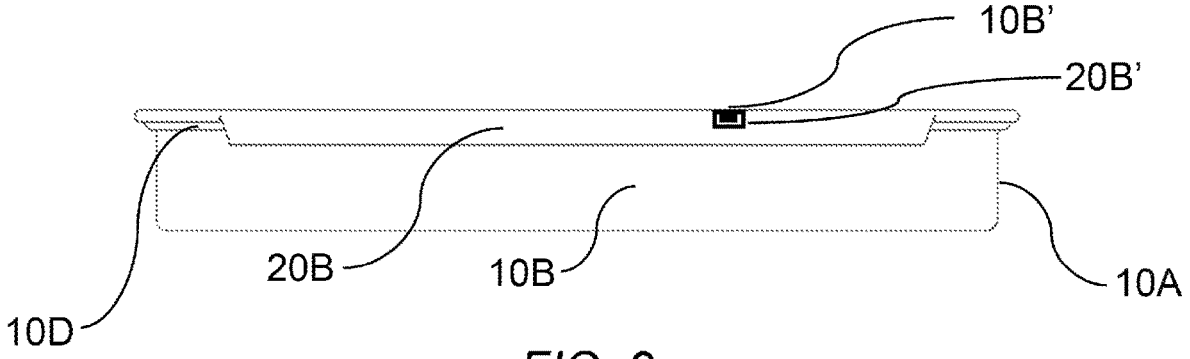
FIG. 2 shows a side-view of the container having the opening covered by the lid in accordance with the first embodiment.
Figure 3:
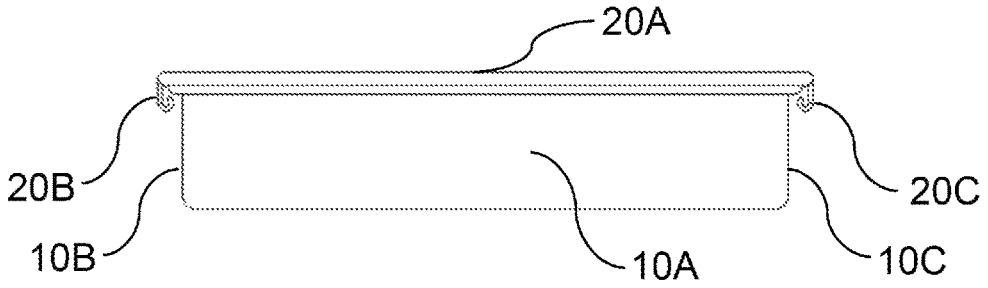
FIG. 3 shows a front-view of the container having the opening covered by the lid in accordance with the first embodiment.
Figure 4:
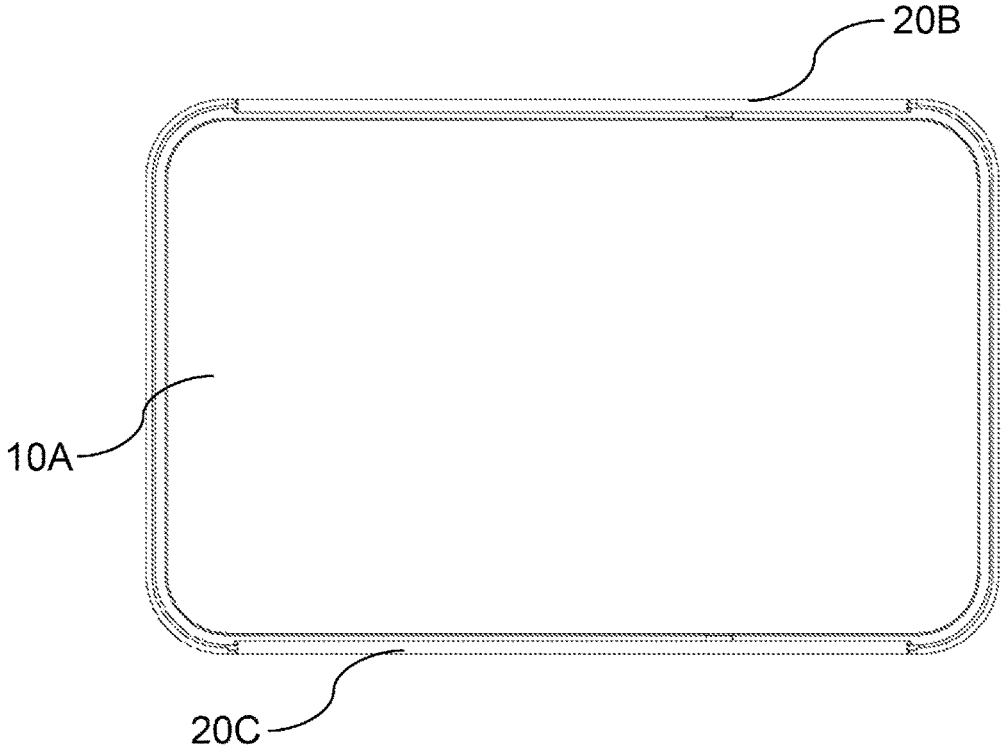
FIG. 4 shows a bottom-view of the container having the opening covered by the lid in accordance with the first embodiment.

The locking assembly includes shaped portions disposed on the lid (20A, 20B, 20C) and on the container (10A, 10B, 10C) that are configured to allow slidable engagement of the lid (20A, 20B, 20C) relative to the container (10A, 10B, 10C) along a movement axis (X) between a first configuration (as shown in FIG. 1A) in which the lid covers the opening in to a second configuration (as shown in FIG. 1B) in which the lid does not cover the opening;

In this embodiment the container is substantially rectangular-shaped and includes side walls (10B, 10C). Shaped portions in the form of a pair of parallel rails (10D, 10E) are disposed along a rim of the container opening on the side walls (10B, 10C) of the container (10A, 10B, 10C). Shaped portions in the form of rail engagement elements (20B, 20C) are also disposed on the lid (20A, 20B, 20C) and are configured for slidable engagement with the parallel rails (10D, 10E).

The lid (20A, 20B, 20C) includes a main body (20A) comprises a substantially flat rectangular portion (20A) that is configured for covering the opening of the container. and side portions (20B, 20C) that extend substantially perpendicularly from elongate side-edges of the main body (20A).

The locking assembly comprises locking nubs (10B', 10C') protruding outwardly from each of the side-walls (10B, 10C) of the container along an axis (Y) which is transverse to the movement axis (X), and, locking nub receiving portions in the form of slots (20B', 20C') that are cut out of each of the side portions (20B, 20C) of the lid. The slots (20B', 20C') are shaped and dimensioned for snugly receiving their corresponding locking nubs. When the lid (20A, 20B, 20C) and container (10A, 10B, 10C) are slidably engaged together in the first configuration, the locking nubs (10B', 10C') disposed on the container (10A, 10B, 10C) are received within the corresponding slots (20B', 20C') disposed on the lid (20A, 20B, 20C) so as to restrict sliding movement of the lid (20A, 20B, 20C) relative to the container along the movement axis (X) from the first configuration in to the second configuration. The wall of the container (which in this embodiment is made from tin or aluminium) is configured to be inwardly depressible by a user so as to cause movement of the locking nubs (10B', 10C)' outwardly of the slots (20B', 20C') whereby the lid (20A, 20B, 20C) is then able to be slidably moved relative to the container (10A, 10B, 10C) along the movement axis (X) from the first configuration in to the second configuration.

In certain embodiments, the locking nubs may be disposed on the lid whilst the locking nub receiving portions may be disposed on the container in reverse fashion.

In yet further embodiments, the container may include a humidity control material. For instance such a material may be disposed on the lid of the container so as to face inwardly of the container when the lid covers the container and to control or regulate humidity within the container during use.

It would be appreciated that embodiments of the present invention as described herein require a degree of cognitive and dexterity ability to open the container which is designed to exceed the ability of young children. Further, such a solution provides added variability to its use that extends in contrast to existing methodologies for effecting child-safe locking mechanisms. Yet further, the streamlined design and relatively simplified function allows it to be applied to a wide variety of container, jars and bottles in numerous materials and sizes. Yet further, embodiments of the present invention are advantageous in that the combined lid/locking collar assembly may be pressed down in to secured engagement with the container when the combined lid/locking collar assembly is arranged in any position of coaxial rotation relative to the container thus making it easier to operate and saving time for the user.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. An apparatus comprising:

a container including a plurality of side-walls defining an opening, wherein at least two of the side-walls extend in parallel along edges of the opening;

a lid in slidable engagement with the at least two parallel side-walls, wherein the lid is selectively moveable between a first configuration in which the lid covers the opening and a second configuration in which the opening is uncovered;

a first protrusion extending from one of the two parallel side-walls; and a first receiving portion positioned along an edge of the lid and corresponding to the first protrusion;

wherein the first protrusion is configured to engage with the first receiving portion to maintain the lid in the first configuration and, upon inward depression of the parallel side-walls, the first protrusion is configured to disengage from the first receiving portion.

2. The apparatus of claim 1, further comprising:

a second protrusion extending from another of the two parallel side-walls and positioned opposite the first protrusion; and a second receiving portion positioned along the edge of the lid and corresponding to the second protrusion;

wherein the second protrusion is configured to engage with the second receiving portion to maintain the lid in the first configuration and, upon inward depression of the parallel side-walls, the second protrusion is configured to disengage from the second receiving portion.

3. The apparatus of claim 2, wherein the lid is movable from the first configuration to the second configuration when both the first protrusion and second protrusion are disengaged from the first receiving portion and the second receiving portion.

4. The apparatus of claim 1, wherein the lid is configured to move between the first configuration and the second configuration along a movement axis and the first protrusion extends transversely to the movement axis.

5. The apparatus of claim 1, wherein upon disengagement of the first protrusion from the first receiving portion, the lid is permitted to move along a movement axis in only one direction.

6. The apparatus of claim 1, wherein the plurality of side-walls includes end-walls connecting the two parallel side-walls at opposing ends of the container; and wherein each of the two parallel side-walls is longer than each of the end-walls.

7. The apparatus of claim 1, wherein the lid is configured to be placed in the first configuration by positioning the lid above opening and pressing the lid downwardly against the container.

8. The apparatus of claim 1, further comprising:

a humidity control material positioned on an interior surface of the container or an interior surface of the lid and configured to regulate humidity within the container.

9. An apparatus comprising:

a container including a plurality of side-walls defining an opening, wherein at least two of the side-walls extend in parallel along edges of the opening;

a lid in slidable engagement with the at least two parallel side-walls, wherein the lid is selectively moveable between a first configuration in which the lid covers the opening and a second configuration in which the opening is uncovered;

a first protrusion extending from an edge of the lid; and a first receiving portion positioned on at least one of the two parallel side-walls and corresponding to the first protrusion;

wherein the first protrusion is configured to engage with the first receiving portion to maintain the lid in the first configuration and, upon inward depression of the parallel side-walls, the first protrusion is configured to disengage from the first receiving portion.

10. The apparatus of claim 9, further comprising:

a second protrusion extending from the edge of the lid and positioned opposite the first protrusion; and a second receiving portion positioned on another of the two parallel side-walls and corresponding to the second protrusion;

wherein the second protrusion is configured to engage with the second receiving portion to maintain the lid in the first configuration and, upon inward depression of the parallel side-walls, the second protrusion is configured to disengage from the second receiving portion.

11. The apparatus of claim 10, wherein the lid is movable from the first configuration to the second configuration when both the first protrusion and second protrusion are disengaged from the first receiving portion and the second receiving portion.

12. The apparatus of claim 9, wherein the lid is configured to move between the first configuration and the second configuration along a movement axis and the first protrusion extends transversely to the movement axis.

13. The apparatus of claim 9, wherein the first receiving portion is one of a slot and a recess.

14. The apparatus of claim 9, wherein the plurality of side-walls includes end-walls connecting the two parallel side-walls at opposing ends of the container; and wherein each of the two parallel side-walls is longer than each of the end-walls.

15. The apparatus of claim 9, wherein the lid is configured to be placed in the first configuration by positioning the lid above opening and pressing the lid downwardly against the container.

16. The apparatus of claim 9, further comprising:

a humidity control material positioned on an interior surface of the container or an interior surface of the lid and configured to regulate humidity within the container.

17. An apparatus comprising:

a container including a plurality of side-walls defining an opening, wherein the plurality of side-walls includes a first side-wall;

a lid configured to engage with one or more of the plurality of side-walls, wherein the lid is selectively moveable between a first configuration in which the lid covers the opening and a second configuration in which the opening is uncovered;

a first protrusion extending from one of an edge of the lid and the first side-wall; and a first receiving portion positioned opposite the first protrusion on another of the edge of the lid and the first side-wall;

wherein the first protrusion is configured to engage with the first receiving portion to maintain the lid in the first configuration and, upon inward depression of the first side-wall, the first protrusion is configured to disengage from the first receiving portion to permit movement of the lid to the second configuration.

18. The apparatus of claim 17, wherein the plurality of side-walls includes a second side-wall, the apparatus further comprising:

a second protrusion extending from one of the edge of the lid and the second side-wall and positioned opposite the first protrusion; and a second receiving portion positioned opposite the second protrusion on another of the edge of the lid and the second side-wall;

wherein the second protrusion is configured to engage with the second receiving portion to maintain the lid in the first configuration and, upon inward depression of the second side-wall, the second protrusion is configured to disengage from the second receiving portion.

19. The apparatus of claim 18, wherein the lid is movable from the first configuration to the second configuration when both the first protrusion and the second protrusion are disengaged from the first receiving portion and the second receiving portion.

20. The apparatus of claim 17, wherein upon disengagement of the first protrusion from the first receiving portion, the lid is permitted to move along a movement axis in only one direction.

* * * * *